United States Patent [19]

Maher

[11] Patent Number: 4,887,446

[45] Date of Patent: Dec. 19, 1989

[54] SYSTEM FOR TRANSFERRING WORKPIECES THROUGH A SERIES OF WORK STATIONS

[76] Inventor: John H. Maher, G-2483 Claywood Dr., Burton, Mich. 48519

[21] Appl. No.: 210,368

[22] Filed: Jun. 23, 1988

[51] Int. Cl.[4] ..... B21J 13/08

[52] U.S. Cl. ..... 72/22; 72/405; 72/421; 198/621

[58] Field of Search ..... 72/405, 421, 21, 12, 72/22, 24; 198/621, 774; 414/750

[56] References Cited

U.S. PATENT DOCUMENTS

| | | | |
|---|---|---|---|
| 3,757,961 | 9/1973 | Jacobs | 198/621 |
| 4,361,413 | 11/1982 | Toda | 72/405 |
| 4,540,087 | 9/1985 | Mizumoto | 72/405 |
| 4,604,021 | 8/1986 | Werner | 72/422 |
| 4,607,516 | 8/1986 | Schafer et al. | 72/405 |
| 4,653,311 | 3/1987 | Tack, Jr. | 72/21 |
| 4,658,626 | 4/1987 | Yamada et al. | 72/405 |

FOREIGN PATENT DOCUMENTS

| | | | |
|---|---|---|---|
| 74330 | 6/1981 | Japan | 72/426 |

*Primary Examiner*—Daniel C. Crane
*Attorney, Agent, or Firm*—Krass & Young

[57] ABSTRACT

A system for transferring workpieces through a series of linearly aligned, equally spaced work stations where a predetermined sequence of operations are performed thereon. The workpieces are transferred along an X axis by a plurality of workpiece gripping finger operators mounted on a transfer rail at equally spaced locations thereon corresponding to the spacing of the work stations. The transfer rail is reciprocated along the X axis for a distance equal to the spacing between adjacent work stations. Independently supported actuator units are provided which have a lateral arm to support the transfer rail and to impart up and down and back and forth movement to it. The mechanism for moving the workpiece in all three axes are individually controllable and may be coordinated with operation of, for example, a transfer press.

18 Claims, 5 Drawing Sheets

SYSTEM FOR TRANSFERRING WORKPIECES THROUGH A SERIES OF WORK STATIONS

BACKGROUND OF THE INVENTION

1. Field of the Invention

This invention relates generally to production systems wherein workpieces are transferred through a series of equally spaced, linearly aligned work stations which perform a predetermined sequence of operations on the workpieces and, more particularly, to such a system for automatically transferring the workpieces from one work station to an adjacent work station within the system.

2. Description of the Relevant Prior Art

Automated and partly automated systems in which a workpiece is conveyed through a series of work stations which each perform one of a series of operations on the workpiece have rapidly become the norm in manufacturing industries such as the metal working industry. In manufacturing operations such as metal stamping, many separate stamping operations may be required to form the flat sheet of metal into an article such as, for example, a vehicle hubcap. Rather than utilizing several separate presses to stamp the part, it has become the industry standard to utilize a transfer feed press, a single stroke of which is used to perform multiple stamping operations at a plurality of work stations. Typically, a pair of matching dies are disposed above and below each work station. At each stroke of the press, a workpiece will be stamped between each pair of dies. As an individual workpiece moves through the series of work stations, it will be successively stamped by each pair of dies to form the finished product.

Obviously, for efficient operation of such a transfer press, it is critically important that a succession of workpieces be simultaneously transferred from one work station to the next between each stroke of the press. Furthermore, it is often necessary to realign the workpiece with the various die stations of the transfer press. For example, the workpiece may have to be moved linearly in either horizontal direction, or it may be necessary to rotate it. Typically, it is necessary to reorient the workpiece a number of times before forming of the piece is finished. It is readily apparent that some means of rapidly and accurately performing multiple transfers and repositionings must be provided.

One system for performing repetitive workpiece transfer and multiple realignment is a type of walking-beam system which provides transfer rails extending along both sides of a linear axis (x axis) through the work stations upon which the workpieces ride between each adjacent work station. Disposed on the transfer rails are finger grippers for gripping the workpieces. In this type of system, each of the rails is designed for movement along both the X and the vertical axis (Z axis), that is, it both raises and lowers the workpiece and moves it linearly from one work station to another. Furthermore, the finger grippers have associated actuators which permit them to move laterally (along the Y axis), toward and away from the workpieces for engagement therewith and disengagement therefrom. Thus, this design permits the finger grippers to first engage the workpiece by operation of its actuator, then raise the workpiece to the transfer level by actuation of the transfer rails, linearly move the workpiece to the next work station by further actuation of the transfer rails, lower the workpiece, and finally disengage from the workpiece by retracting the finger grippers therefrom so that the press may be operated.

Although such transfer systems are in wide use, they present many disadvantages. For example, many smaller stamping manufacturers and sheet metal die builders do not have transfer presses, which represent a substantial investment, but have a need to duplicate the action of a transfer press for die tryout purposes or short production runs.

Because a standard transfer press supports the rails at each end of the x-axis, rather than in the middle, the rails are typically very heavy, and have a cross section designed to minimize sag. Moving the mass of these rails at production speeds requires large gears and cams, and a massive framework to support the mechanism and provide stability thereto.

Furthermore, standard transfer presses typically have standardized rail positions and permit only two or three different spacings between the rails in the lifted position. Standard transfer presses also have only a limited number of settings along the x-axis and no adjustment of distance of travel in either the up-down or back-forth directions. To exacerbate this problem, the standardized settings are peculiar to each manufacturer and not standardized industry wide. Hence, it would be virtually impossible for one shop to have transfer presses capable of testing or running the many possible combinations of available settings from various press manufacturers.

A further problem with standard transfer presses is the lack of provision for easy removal of the rails for access for purposes o changing the dies. The transfer rails must be longer than the distance between the columns of the press since they also serve to load the workpiece into the press and unload it therefrom. Therefore, elaborate coupling mechanisms are necessary to allow removal of a portion of the rail when the tooling is removed. Die change capability is, therefore, an expensive option and permits rail change or removal only with great difficulty.

As a partial solution to some of these problems, U.S. Pat. No. 4,621,526 to Schafer et al discloses a system wherein the transfer rail does not travel in the linear direction from one station to another. Rather, a secondary rail is mounted thereon and the finger units are in turn mounted on the secondary rail. The secondary rail is designed for reciprocal movement along the X axis between adjacent work spaces. This movement is actuated by a servomotor supported on the secondary rail. The finger units themselves are designed for lateral movement toward and away from the workpiece and are actuated by additional servomotors. In order to raise and lower the workpieces, lift columns are provided upon which the transfer rail is mounted. These lift columns are also actuated by electric servomotors. Hence, according to Schafer'design, only the servomotors which cause lateral movement of the finger units are actually carried along the secondary rails, thus reducing the size of the rails, simplifying the system and making it less prone to failure Less of the mechanism is actually disposed within the press, thus providing a less obstructed operation thereof. However even with Schafer'improvements, much of the mechanism is still disposed on the transfer rails. Furthermore, existing systems cannot be modified to add these improvements.

It would be desirable to provide transfer rails which are supported in the center to allow a much smaller rail cross section and permit the transfer system to be built to any length. Such a modular system would provide the capability of building longer transfer systems than is presently possible.

It would also be desirable to provide a more flexible transfer system permitting a multiplicity of rail positions and adjustment of finger unit travel in each of the three directions of travel.

Further, it would be desirable to provide an improved, economical system whereby the finger units may be disposed on the rails in relation to the workpiece during die building and tryout, when a transfer press is typically not available. Such a system should also allow greater accessibility to the dies during maintenance and repair by containing the actuator system for the transfer mechanism in separate modules which may be removed, leaving the rails in proper position in relation to the workpiece.

It would also be desirable to provide a system which can be used in a die shop to simulate the action of any transfer press in order to check for proper clearances of moving parts of the dies in relation to the path of travel of the transfer rail, finger units and workpieces without the necessity of actually setting the dies in a transfer press.

It would highly advantageous to devise a modular system wherein modules may be manufactured in a limited number of sizes and can be used with presses of a variety of sizes and of various configurations, regardless of the direction of feed or of the press design.

SUMMARY OF THE INVENTION

The present invention provides a modular system particularly useful for transferring work pieces along a series of equally spaced, aligned work stations. While the preferred embodiment of the invention is used with a transfer feed press, the system is useful for transferring workpieces in any system having a series of equally spaced work stations aligned linearly along an axis whereon a predetermined sequence of operations is performed on the workpieces.

In the preferred embodiment such as welding, milling, etc., a pair of spaced and parallel transfer rails extend longitudinally along both sides of the aligned work stations. Preferably, the pair of rails is side mounted in order to allow access to the press. A plurality of workpiece gripping finger operators which are adapted to grip the workpiece and transfer it between adjacent work stations are mounted on each transfer rail at equally spaced locations thereon corresponding to the spacing of the series of work stations. The plurality of finger operators may be mounted directly on the transfer rails, or may be mounted on an individually controllable finger operator rail which, in turn, is mounted on each transfer rail.

Each of the finger operators extends laterally toward its associated work station and terminates in a free end having a workpiece engaging mechanism mounted thereon. The workpiece engaging mechanism is adapted to grip the workpieces and transfer them between adjacent work stations. The workpiece engaging mechanism can take a number of standard configurations, including horizontally extended fingers which are adapted to lift the workpiece from underneath, or a pincher type of mechanism which allows the workpieces to be grasped and picked up. In the later case, it is contemplated that a transfer system may include only one transfer rail extending longitudinally and in spaced and parallel relation to an axis along which the work stations are oriented. The pincher type of workpiece transfer mechanism grasps the workpieces from one side only and transfers them between adjacent stations. Such a single rail system may find use in transferring relatively small and light workpieces. With the horizontally extending finger type of workpiece transfer mechanism which lifts the workpieces up, it is necessary to have two parallel transfer rails and associated finger operators which lift the workpieces on both sides. Such a system is suitable for transferring relatively large and heavy workpieces such as are commonly subject to stamping operations in a transfer press.

Individually controllable means are provided for imparting reciprocal linear motion to the plurality of finger operators along the direction of travel of the workpieces as they pass through the series of aligned work stations. If the plurality of finger operators are mounted directly on the transfer rail, then the means for imparting reciprocal motion will act directly on the transfer rail. Alternately, the finger operator rail may be reciprocally moved. To this end, the finger operator rail is mounted on the transfer rail by means of a plurality of wheels, rollers or the like, and a linear induction motor is disposed inside the transfer rail. Other means of providing reciprocal linear motion are alternatively contemplated, such as electric servo motors, motors having drive belts and drive gears, etc.

At least one individually controllable, modular actuator unit is provided which is supported independently from the transfer rail and is disposed at a location displaced laterally therefrom on a side thereof opposite the work stations. If a pair of transfer rails are provided, then at least one pair of actuators will be provided, with one disposed beside each transfer rail. Each actuator unit has a laterally extending arm which supports the transfer rail and is adapted to impart both lateral and up and down motion thereto. The lateral motion is along the Y axis in a direction corresponding to movement of the finger operators into and out of engagement with the workpieces. The up and down motion is along the Z axis and corresponds to movement of the finger operators for raising and lowering the workpieces.

The transfer system of the instant invention possesses the advantages of providing movement of the finger operators in all three directions necessary to effect transfer of the workpieces and realignment thereof. In contrast to prior art systems, none of the actuators which provide movement in the three directions are disposed on the transfer rail itself. Hence, the transfer rail may be made smaller and lighter. Furthermore, the actuator units are independently supported from the transfer rail, resulting in an efficient, modular system.

Preferably, the transfer system further comprises at least one sensor means for detecting the state of operation of the associated production system for purposes of synchronizing the operation of the transfer mechanism to the system. While the sensor means may comprise any conventional sensor means, it is preferable that it be an absolute position transducer. In the case of a transfer press, a sensor means will be mounted on the press ram in order to sense the position of the ram during each stroke of the press. The sensor is operatively connected to a means for centrally controlling movement of the transfer rail and finger operators to synchronize travel of the workpieces through the successive work stations in timed relation with performance of the sequence of operations. Through this central control system, a large number of complicated transfers and multiple realignments may be performed in synchronized fashion with the operation of the press in an quick, accurate and efficient manner.

The linear actuators are supported independently from the transfer rail. In one embodiment, the linear actuators are mounted on the crown of the press itself. In another embodiment, they are mounted on the die bolster. It has been a common practice to mount a conventional transfer rail on the lower die by means of a cross slide system formed in the die which permits the transfer rail to move both up and down and back and forth. It is a relatively simple matter to adapted such a conventional, die mounted transfer rail for use with the instant invention.

In another embodiment, the actuator units are floor mounted, preferably on castors or wheels so that the actuator units may be moved toward and away from the work stations as desired. By using displaceable actuator units, it is a relatively easy matter to disassemble the transfer system when the dies need to be changed or repositioned.

Preferably, a carriage unit is detachably mounted on a free end of the arm for supporting the transfer rail. Hence, the actuator unit may be easily detached from the transfer rail and disassembly of the system becomes even easier.

BRIEF DESCRIPTION OF THE DRAWINGS

The above described and further features and advantages of the herein invention may best be understood by reference to the following detailed description and drawing in which.

DETAILED DESCRIPTION OF THE PREFERRED EMBODIMENT

Figure 1:
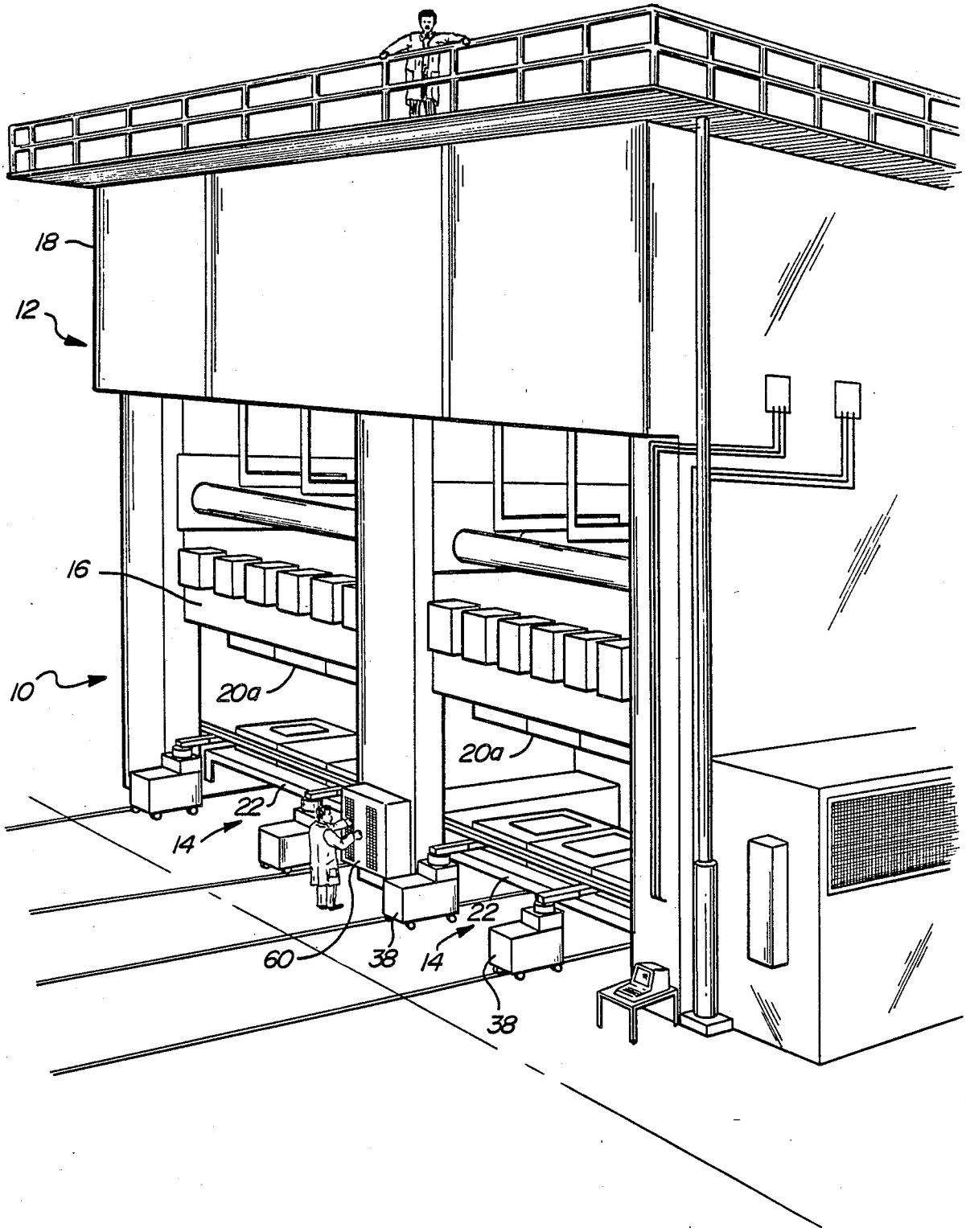
FIG. 1 is a perspective view of the transfer system of the instant invention installed in a transfer press.

Throughout the following detailed description, like reference numerals are used to refer to the same element shown in multiple Figures thereof.

Figure 2:
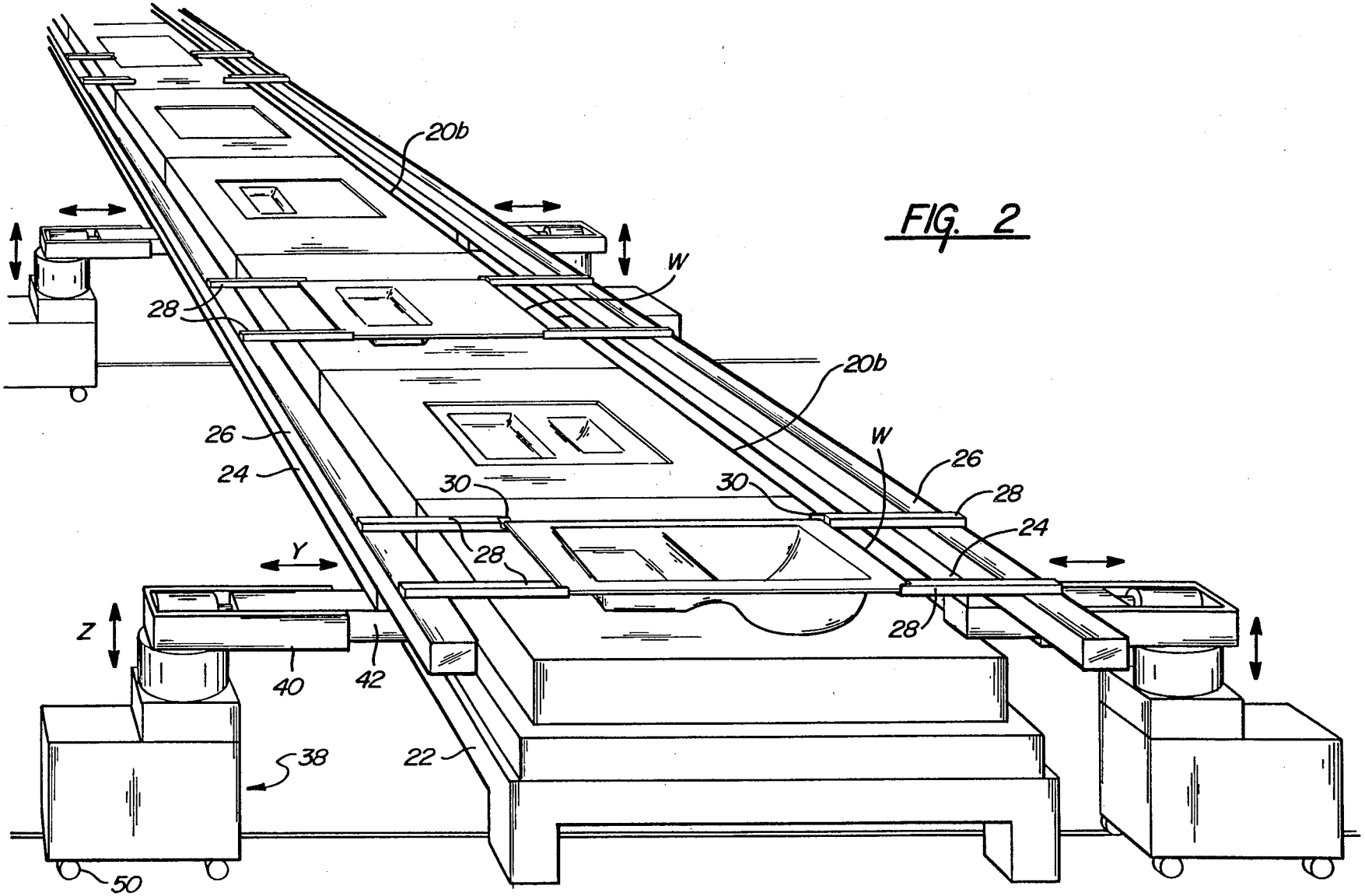
FIG. 2 is an end on perspective view of the transfer system of FIG. 1 shown apart from the transfer press.

Referring now to the drawing and in particular to FIGS. 1 and 2, there is shown a workpiece transfer system generally designated as 10 installed in a transfer press generally designated as 12. Transfer press 12 has a plurality of work stations 14 wherein a series of stamping operations are performed on a succession of workpieces W. A ram 16 supports a plurality of upper die halves 20*a* and each stroke of ram 16 causes the workpieces W to be stamped between an upper die 20*a* and an associated lower die 20*b* to form the workpieces W. As is conventional, the lower dies 20*b* are mounted on bolsters 22 and the upper dies 20*a* are mounted on the ram 16. The upper stationary part of the transfer press 12 is referred to as the crown 18.

A pair of transfer rails 24 extend longitudinally in parallel and spaced fashion along both sides of the plurality of work stations 14, as may be seen in FIGS. 1 and 2. Mounted on each of the pair of transfer rails 24 is a finger operator rail 26. Mounted in turn on the finger operator rails 26 are a plurality of fingers 28 which extend laterally toward the workpieces W. Each of the plurality of fingers 28 terminates in a workpiece engaging section 30. In the embodiment illustrated, each of the workpiece engaging sections 30 is shown as a supporting surface S formed by a block shaped member 30*a* having a similar, smaller block shaped cut out 30*b*, as most clearly may be seen in FIGS. 3 and 4. The supporting surface S provides a resting place for a corner of each of the plurality of workpieces W as they are successively transferred from one adjacent work station 14 to another work station 14. It is to be understood, however, that the plurality of workpiece transfer mechanisms 30 may take a variety of other conventional designs and configurations, such as, for example, grasping fingers.

The plurality of finger operators 28 are equally spaced longitudinally along the pair of transfer rails 24. In the case of the workpieces W shown in the drawing, the finger operators 28 are arrayed in pairs so that the workpiece transfer mechanisms 30 may support each corner of a workpiece W. The spacing between adjacent pairs of finger operators 28 corresponds to the spacing between adjacent work stations.

Figure 3:
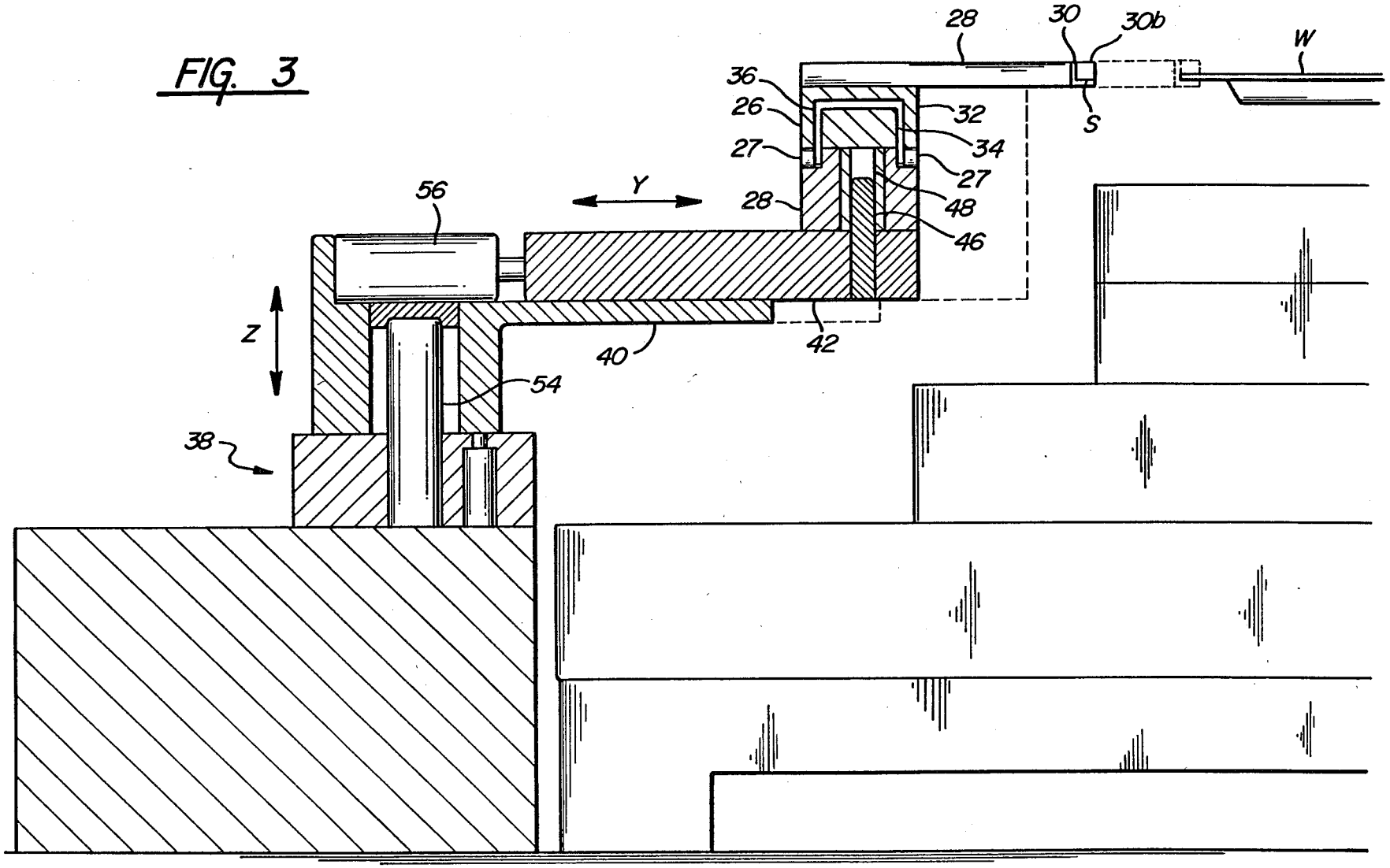
FIG. 3 is a cross section along line 3—3 showing details of the transfer system of FIG. 2 with certain portions shown in phantom to indicate a direction of movement, along the Y axis.

As may be seen with reference to FIG. 3, which is a cross sectional view of a portion of the transfer system 10, finger operator rail 26 is roller mounted on transfer rail 24 by means of multiple pairs of rollers 27 in order to permit reciprocal, linear motion of the finger operator rail 26 with respect to the transfer rail 24. Such reciprocal, linear movement of finger operator rail 26 is created by means of a linear induction motor 32. Linear induction motor 32 is comprised of field core 34 which is mounted on transfer rail 24 and pole piece 36 which is mounted inside finger rail 26. When powered by appropriately controlled electrical current, the motor will provide reciprocal linear motion of rail 26 with respect to rail 24. Although in the embodiment shown linear actuator motor 32 is used to create such linear, reciprocal movement, it is to be understood that the system of the present invention is not limited to this embodiment. Rather, any means for creating reciprocal, linear motion could be used, such as, for example, a hydraulic cylinder, a gear drive system, etc.

Figure 4:
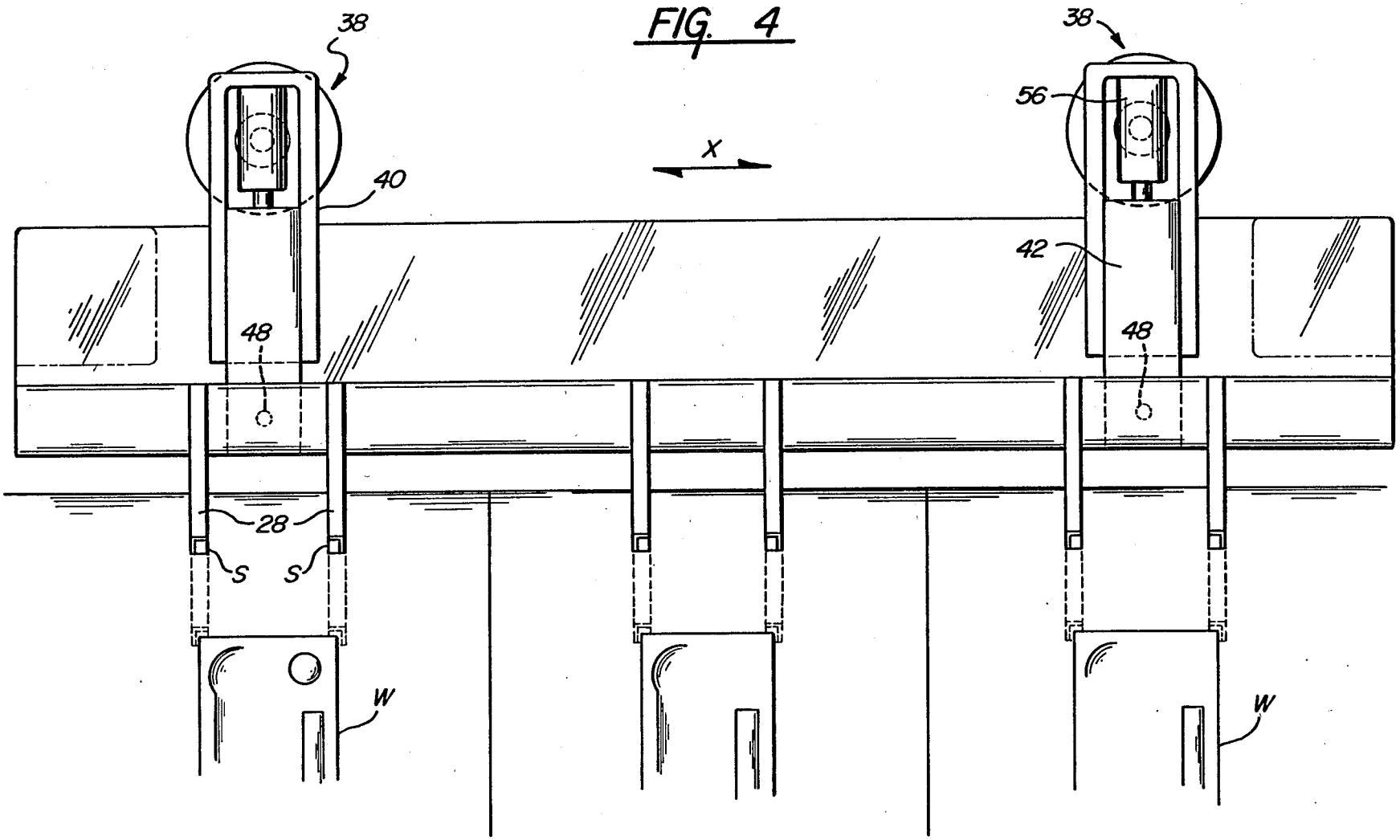
FIG. 4 is a top plan view of a portion of the transfer press of FIG. 2.

The linear reciprocal movement of finger operator rail 26 along transfer rail 24 causes the finger units 28 also to move reciprocally in a linear direction along the X axis as is shown in FIG. 4. In order to cause the finger operators 28 to move in the Z direction (up and down) and in the Y direction (laterally, into and out of engagement with the workpiece W), at least one actuator unit 38 is provided. Actuator unit 38 is supported independently of transfer rail 24. In the embodiment shown, actuator unit 38 is floor mounted by means of casters or wheels 50 which permit actuator unit 38 to easily be moved. However, actuator unit 38 could, alternatively, be mounted directly on the crown of the press, or any other suitable location. Actuator unit 38 includes a laterally extending arm 40 which extends toward the direction of the workpiece. Lateral arm 40 further includes transfer carriage 42 which supports transfer rail 24. In the embodiment shown in FIG. 2, a plurality of actuator units 38, and associated lateral arms 40 and transfer carriages 42 are provided in order to adequately support the pair of transfer rails 24. It is contemplated that at least one actuator unit 38 will be needed for each transfer rail 24, and typically, at least one pair of actuator units 38 will be needed to support each transfer rail 24.

Figure 5:
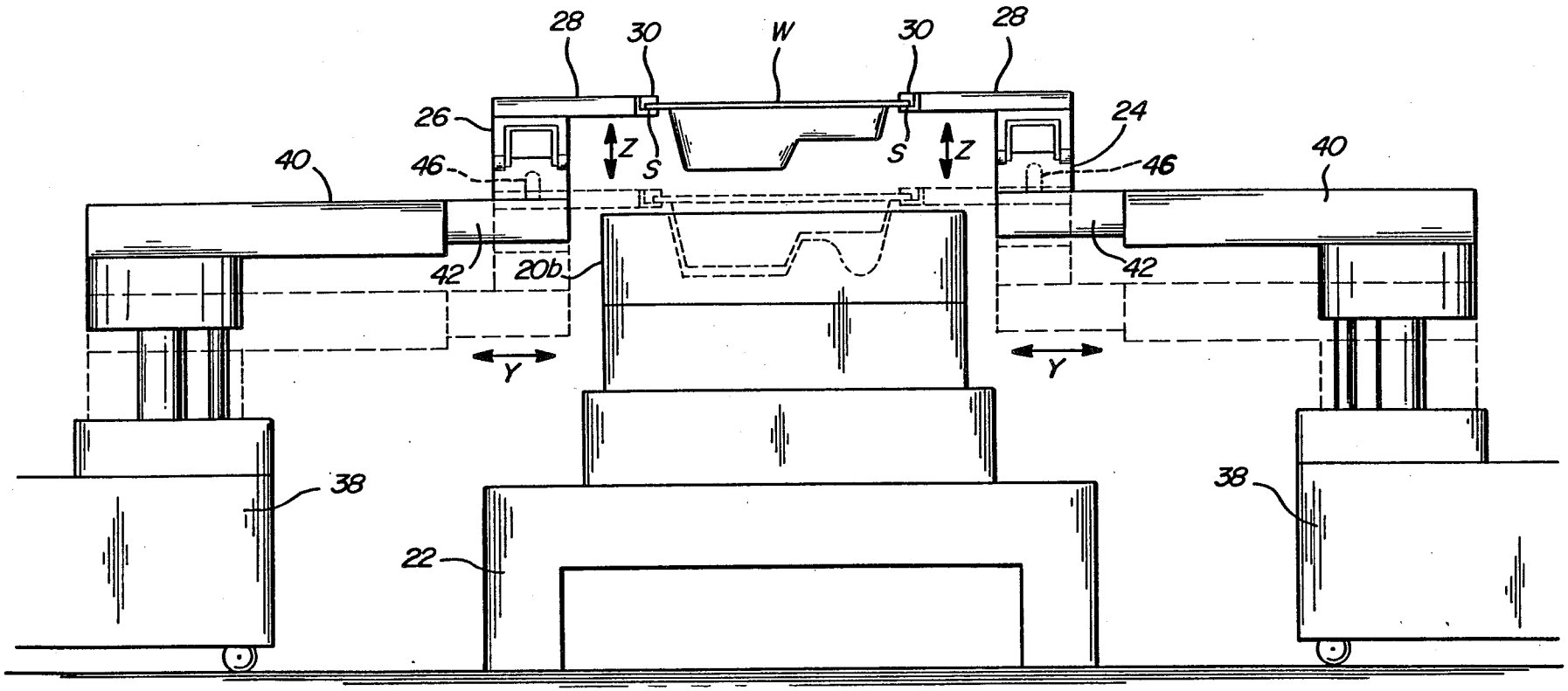
FIG. 5 is an end-on, elevational view of the transfer press of FIG. 2 with certain portions shown in phantom to indicate a direction of movement along the Z axis.

As may be seen in FIGS. 3, 4 and 5, the transfer rails 24 are not permanently mounted on the transfer carriages 42. Rather, in order to permit the modular system 10 to be easily disassembled, a detachable mounting is provided. To this end, each transfer carriage 42 is provided with an upwardly extending projection 46 and each transfer rail is provided, at suitable locations thereon, with an upwardly extending bore 48 formed on a lower surface thereof. Each projection 46 is adapted to be insertable into a bore 48.

By means of lift actuator 54, carriage 42 is capable of movement in the Z direction. Transverse actuator 56 is provided in order to impart movement along the Y axis to transfer carriage 42. Movement of transfer carriage 42 along either or both the Y and Z axes will cause transfer rail 24, finger operator rail 26, and the plurality of finger operators 28 and workpiece transfer mechanisms 30 carried thereon to move correspondingly.

The movement of transfer carriage 42 in the Y direction is illustrated in FIG. 3. The solid lines show the position of the various structures when transverse actuator 56 is in a retracted position. When transverse actuator 56 is in an extended position, the positions of the various structures carried thereon are displaced inwardly as is in phantom. It can be seen that workpiece engaging mechanism 30 is not engaged with the workpiece when transverse actuator 56 is in the retracted position. However, in the extended position, workpiece transfer mechanism 30 engages with workpiece W, a corner of which rests upon support surface S, in the manner shown in FIG. 3.

The movement of the system along the Z axis is shown in FIG. 5. When lift actuator 54 is in its extended position, lateral arm 40, transfer carriage 42, and its associated structures are in their highest position shown in solid lines. When lift actuator 54 is in its retracted position, the various structures move downward into the lower position as shown in phantom lines. When lift actuator 54 is extended and the system is in the higher position, workpiece W is held above lower die **20*b* in a non-operational position. When lift actuator 54 retracts, the system moves downward causing the workpiece to be positioned onto the die 20*b*** so it may be subsequently stamped.

Hence, the herein workpiece transfer system permits the plurality of workpieces W to be moved along all three axes of movement. The movement of a single workpiece W during a typical cycle of transfer press 12 will now be described. In order to permit the workpiece W to be loaded onto the transfer press, typically the pair of finger operator rails 26 are made longer than the rest of the system, as may be seen in FIG. 2. Assume that such loading is performed when the workpiece transfer mechanisms 30 are in the raised, engaged position shown in solid lines in FIG. 5. That is, lift actuators 54 are in their extended position and transverse actuators 56 are also extended. By operation of linear induction motor 32, workpiece W is made to travel along the X axis toward the first work station 14. As soon as it reaches a predetermined correct position along the X axis for proper alignment with upper and lower dies **20*a* and 20*b*, movement along the X axis will cease, and lift actuator 54 will be retracted, thereby causing lowering of the workpiece W into the operational position. Transverse actuator 56 will also be retracted to disengage workpiece W from workpiece transfer mechanism 30. The ram 16 will then be operated to cause stamping of the workpiece W between die pieces 20*a* and 20*b*. After completion of its stroke, ram 16 will lift. During the time when workpiece transfer actuators 30 are disengaged from workpiece W, during the stroke of the ram, if the die configuration permits the linear induction motor 32 may reciprocate finger operator rail 26 along the X axis in an opposite direction, thus causing a new set of finger operators 28 to be in position for engagement with workpiece W. Transverse actuator 56 will then move along the Y axis into its extended position, causing engagement of workpiece transfer mechanism 30 with the workpiece W. Lift actuator 54 will move along the Z axis into its extended position to lift the workpiece back into the position shown in solid lines in FIG. 5. After engagement of workpiece transfer mechanisms 30 with workpiece W, as described above, linear induction motor 32 will then displace workpiece W along the X axis for a sufficient distance to cause it to be aligned with the next work station 14. The cycle is then repeated. At each cycling of the transfer system 10, a plurality of workpieces are transferred between each adjacent work station 14. In order for a single workpiece W to travel through all of the plurality of work stations 14, it will be necessary for the system to cycle as many times as there are work stations 14**.

Obviously, in order to keep the system operating correctly and efficiently, it is necessary that each one of the single displacements of the plurality of workpieces W through all three axes must be performed accurately with respect to both distance displaced and time of displacement. To that end, it is contemplated that each linear induction motor 32 and each of the plurality of lift actuators 54 and transverse actuators 56 be independently controllable. The independent control means (not shown) for each of the induction motors 32 and actuators 54, 56 are connected to a central controller 60, shown in FIG. 1. Sensor means 62 are used to sense the position of the rams 16. By feeding information from sensor means 62 into central control means 60, the operation of each component of system 10 may be coordinated so that transfer and alignment of the plurality of workpieces W is synchronized with the operation of transfer press 12. Since each of the various actuators 32, 54, 56 is independently controllable, the system 10 may be used to realign and reposition the plurality of workpieces W as required by each stamping operation. For example, the right member of a pair of finger operator rails 26 may be made to move at a faster rate than the left member. Such movement would cause the workpiece W to rotate somewhat. Similarly, movement of the actuators 54, 56 may be varied as necessary to adjust to required operating conditions.

As shown in the preferred embodiment, actuators 54, 56 are hydraulic cylinders. Again however the invention contemplated herein is not limited to this type of actuator, but may include any other suitable means of imparting linear motion.

It may be seen how the therein system is adaptable for operation with a wide variety of different transfer press designs of varying sizes. Thus, in an installation having transfer presses of various types, it is possible to move the operating system 10 from one transfer press to another. The system is modular, and as many components may be added as are necessary to accommodate the size of the press and the number of work stations therein. The actuator units 38 may be used with existing systems having die mounted transfer rails which utilize a cross slide bracket. Hence, retrofitting of existing systems is inexpensive and easy. Furthermore, when die change operations are necessary, it is much easier to disassemble the system of the present invention than is the case with prior art systems. In the embodiment shown, the lift actuators 36 may easily be disengaged from the transfer rails 24 and rolled away. Furthermore, in contrast to prior art systems where the various actuator components are mounted directly on the transfer rail and interfere with operation of the press, the actuators of the present system are deployed outboard of the press itself, thus resulting in easier operation, as well as in a reduction of the bulk of the rail necessary to support the system.

While the herein embodiment has been described installed in a transfer press, it is contemplated that it may be adapted for use in any system requiring repetitive transfer of a plurality of workpieces from one equidistant work station to another. For example, such repetitious transfer may be needed in operating a punch press, a coating system, a paint sprayer, etc. Furthermore, other such applications may occur to one skilled in the art without departing from the spirit of the herein invention. Therefore, the scope of the present invention is not limited to the embodiments and exemplifications depicted and described herein, but rather by the claims appended hereto.

I claim:

1. For use in conjunction with an article forming press which includes a ram having an upper die associated therewith adapted to be driven along a path of travel in a Z-axis and engagable with a lower die supported by a bolster for forming a workpiece inserted therebetween, a system for transferring work stations aligned linearly along an X axis perpendicular to the Z axis, to perform a predetermined sequence of operations on the workpieces, said system comprising:

a transfer rail extending longitudinally in spaced and parallel relation to the X axis and having a finger operator rail mounted thereupon for movement with respect thereto in a direction parallel to the X-axis;

a plurality of workpiece gripping finger operators mounted on the finger operator rail at equally spaced locations thereon corresponding to the spacing of the work stations, said finger operators extending laterally in a Y axis, perpendicular to the X axis and Z axis and each terminating in a free end having a workpiece engaging section adapted to engage the workpieces and transfer them between adjacent work stations;

individually controllable means for imparting reciprocal motion, along the X-axis, to the finger operator rail for a distance equal to the spacing between adjacent work stations; and at least one individually controllable, modular actuator unit, the entirety of said actuator unit supported independently from the transfer rail and disposed at a location displaced laterally along the Y axis from the ram, dies, bolster and path of travel of the ram, said actuator unit having an arm which extends therefrom in the Y direction and which is operative to move the transfer rail along both the Y and Z axes.

2. The system of claim 1 further comprising means for centrally controlling movement of the transfer rail and finger operators to synchronize travel of the workpieces through successive work stations in timed relation with performance of the sequence of operations.

3. The system of claim 1 wherein the sequence of work stations are associated with a transfer press.

4. The system of claim 1 wherein the finger operator rail is roller-mounted on the transfer rail.

5. The system of claim 1 wherein the means for imparting motion to the transfer rail comprises a linear induction motor mounted therein.

6. The system of claim 1 wherein the finger operator rail extends for a distance beyond each end of the transfer to permit transfer of the workpieces onto and off of the system.

7. The system of claim 1 wherein the at least one actuator unit is floor-mounted.

8. The system of claim 7 wherein the at least one actuator unit is displacably mounted with respect to the floor.

9. The system of claim 1 wherein the at least one actuator unit further comprises a carriage unit for supporting the transfer rail.

10. The system of claim 1 wherein the arm of the at least one actuator unit has an upwardly extending projection formed thereon and the transfer rail has a mating bore formed on a lower surface thereof for easy separation of the transfer rail from the actuator.

11. A transfer press automation system for transferring workpieces along a series of equally spaced, aligned work stations of a transfer feed press having a ram associated therewith, said system comprising:

a transfer rail disposed along an x-axis extending longitudinally along a side of said work stations;

an individually controllable finger operator rail mounted on said transfer rail for movement with respect thereto for a distance equal to the spacing between adjacent work stations and in a direction corresponding to the X-axis and defining the direction of workpiece movement through the work stations;

linear actuator means associated with said transfer rail and its associated finger rail, said linear actuator means operative to effect the movement of the finger rail;

a plurality of workpiece-engaging fingers supported on the finger rail at equally spaced locations thereon corresponding to the spacing of the series of work stations, each of said fingers extending laterally toward the transfer rail along a Y axis perpendicular to the X-axis and terminating in a free end having a workpiece engaging mechanism mounted thereon adapted to engage the workpieces; and an independently mounted, individually controllable actuator unit associated with the transfer rail and disposed along the Y axis and on a side of the transfer rail opposite the series of work stations, said actuator unit adapted to support its associated transfer rail and impart motion thereto in directions corresponding to both the Y axis and a Z axis which is perpendicular to the X and Y axes and defining, respectively, the direction of finger operator movement into and out of engagement with the workpieces and the movement of the finger operators for raising and lowering the workpieces.

12. The system of claim 11, wherein said linear actuator means comprises a linear induction motor.

13. The system of claim 12, wherein said linear induction motor includes a field core associated with the transfer rail and a pole piece associated with the finger rail.

14. In a system for transferring workpieces through a series of equally spaced work stations aligned linearly along an axis to perform a predetermined sequence of operations on the workpieces, in combination with at least one transfer rail extending longitudinally in spaced and parallel relation to the work station axis and including a linear induction motor associated therewith for imparting linear motion to the rail with respect to the work station axis for a distance corresponding to the distance between work stations, and a plurality of workpiece gripping finger operators extending laterally in the direction of the work station axis and each terminating in a free end having a workpiece engaging section adapted to engage the workpieces and transfer them between adjacent work stations, and at least one individually controllable, modular actuator unit associated with only one of said at least one transfer rail and supported independently from the associated transfer rail and disposed at a location displaced laterally therefrom on a side thereof opposite the work station axis, said actuator unit having a laterally extending arm which supports the associated transfer rail and is adapted to impart both lateral and vertical motion thereto in directions corresponding, respectively, to finger operator movement into and out of engagement with the workpieces and movement of the finger operations for raising and lowering the workpieces.

15. The system of claim 14 further comprising means for centrally controlling movement of the transfer rail and finger operators to synchronize travel of the workpieces through successive work stations in timed relation with performance of the sequence of operations.

16. The system of claim 14 wherein the sequence of work stations are associated with a transfer press for repetitive stamping of the workpieces between a pair of upper and lower dies disposed at each work station.

17. The system of claim 14 wherein the at least one actuator unit further comprises a carriage unit for supporting the transfer rail.

18. For use in conjunction with an article forming press which includes a ram having an upper die associated therewith adapted to be driven along a path of travel in a Z-axis and engageable with a lower die supported by a bolster for forming a workpiece inserted therebetween, a system for transferring workpieces through a series of equally spaced work stations aligned linearly along an X axis perpendicular to the Z axis, to perform a predetermined sequence of operations on the workpieces, said system comprising:

a pair of transfer rails extending longitudinally in mutually spaced and parallel relation along either side of the X axis;

a plurality of workpiece gripping finger operators mounted on each transfer rail at equally spaced locations thereon corresponding to the spacing of the work stations, said finger operators extending laterally in a Y axis, perpendicular to the X axis and Z axis and each terminating in a free end having a workpiece engaging section adapted to engage the workpieces and transfer them between adjacent work stations;

individually controllable means for imparting reciprocal motion, along the X-axis, to each transfer rail for a distance equal to the spacing between adjacent work stations; and at least one individually controllable, modular actuator unit associated with each transfer rail, the entirety of said actuator unit being supported independently from the transfer rail and disposed at a location displaced laterally along the Y axis from the ram, dies, bolster and path of travel of the ram, said actuator unit having an arm which extends therefrom in the Y direction and which is operative to move the transfer rail along both the Y and X axes.

* * * * *

UNITED STATES PATENT AND TRADEMARK OFFICE

CERTIFICATE OF CORRECTION

PATENT NO. : 4,887,446

DATED : December 19, 1989

INVENTOR(S) : Maher

It is certified that error appears in the above-identified patent and that said Letters Patent is hereby corrected as shown below:

Column 10, line 12, after "fer" insert --rail--.

Signed and Sealed this

Thirtieth Day of April, 1991

*Attest:*

HARRY F. MANBECK, JR.

*Attesting Officer*

*Commissioner of Patents and Trademarks*